US007097288B2

(12) United States Patent
Van Os et al.

(10) Patent No.: US 7,097,288 B2
(45) Date of Patent: Aug. 29, 2006

(54) INK SUPPLY SYSTEM FOR AN INK JET PRINTER

(75) Inventors: Albertus Matheus Berendina Maria Van Os, Grathem (NL); Henricus Wilhelmus Cornelia Douven, Nederweert-Eind (NL)

(73) Assignee: OCE-Technologies B.V., MA Venlo (NL)

( * ) Notice: Subject to any disclaimer, the term of this patent is extended or adjusted under 35 U.S.C. 154(b) by 132 days.

(21) Appl. No.: 10/642,157

(22) Filed: Aug. 18, 2003

(65) Prior Publication Data

US 2004/0032469 A1 Feb. 19, 2004

(30) Foreign Application Priority Data

Aug. 16, 2002 (EP) ..... 02078439

(51) Int. Cl.
*B41J 2/175* (2006.01)

(52) U.S. Cl. ..... 347/85

(58) Field of Classification Search ..... 347/84, 347/85, 86, 87; 141/2, 18
See application file for complete search history.

(56) References Cited

U.S. PATENT DOCUMENTS 4,967,207 A * 10/1990 Ruder ..... 347/7
5,992,992 A 11/1999 Gibson
6,179,401 B1 * 1/2001 Stephens et al. ..... 347/19
6,328,424 B1 12/2001 Denton et al.
6,390,611 B1 * 5/2002 Kobayashi et al. ..... 347/84
6,540,321 B1 * 4/2003 Hirano et al. ..... 347/22
6,612,689 B1 * 9/2003 Suenaga et al. ..... 347/85
6,629,758 B1 * 10/2003 Okamoto et al. ..... 347/85

FOREIGN PATENT DOCUMENTS

JP 06-106729 A * 4/1994 ..... 347/85
JP 2000334975 5/2000

OTHER PUBLICATIONS

Patent Abstracts of Japan, vol. 018, No. 304 (M-1619), Jun. 10, 1994 & JP 06 064182 A, Mar. 8, 1994.

* cited by examiner

*Primary Examiner*—Anh T.N. Vo
(74) *Attorney, Agent, or Firm*—Birch, Stewart, Kolasch & Birch, LLP

(57) ABSTRACT

An in supply system for an ink jet printer, comprising:
an ink cartridge for accommodating a limited volume of liquid ink,
and ink tank having a volume larger than said limited volume and connectable to the ink cartridge, and
an ink supply line including a disengageable coupling, for connecting the ink tank to the ink cartridge,
wherein the coupling includes a valve mechanism which, when the coupling is disengaged, automatically blocks the ink supply line and opens a vent passage for venting the interior of the cartridge.

8 Claims, 3 Drawing Sheets

INK SUPPLY SYSTEM FOR AN INK JET PRINTER

BACKGROUND OF THE INVENTION

This non-provisional application claims priority under 35 U.S.C. § 119(a) on Patent Application No. 02078439.3 filed in Europe on Aug. 16, 2002, which is herein incorporated by reference.

FIELD OF THE INVENTION

The present invention relates to an ink supply system for an ink jet printer.

RELATED ART

Many commercial ink jet printers comprise an ink cartridge which is directly associated with a nozzle head of the printer and is mounted on a carriage for scanning a recording medium to be printed. Since the cartridge is travelling back and forth along with the carriage and the nozzle head, it can only accommodate a limited volume of liquid ink. When the ink cartridge is depleted, it has to be replaced manually. It would therefore be desirable to be able to store a larger volume of ink, especially for printing images with a large format or high volume printers.

It is accordingly an object of the present invention to provide an ink supply system in which a large-volume ink tank can be connected to the ink cartridge for replacing the ink that has been consumed.

SUMMARY OF THE INVENTION

According to the present invention, this object is achieved by providing an ink supply system for an ink jet printer, comprising:

an ink cartridge accommodating a limited volume of liquid ink, an ink tank having a volume larger than said limited volume and connected to the ink cartridge, and an ink supply line including a disengageable coupling for connecting the ink tank to the ink cartridge, wherein the disengageable coupling includes a valve mechanism which, when the coupling is disengaged, automatically blocks the ink supply line and opens a vent passage for venting the interior of the cartridge.

The system according to the present invention, connects the ink cartridge to the large-volume ink tank for supplying ink to the cartridge. When the coupling is engaged, the vent passage is blocked, so that the ink supply system is sealed against atmospheric pressure. As a result, it is possible to create a differential pressure between the ink tank and the ink cartridge and thereby cause the ink to flow from the tank into the cartridge. For example, the ink in the tank may be contained in a collapsible bag, and when the nozzle head is operating and ink is consumed. This will cause a sub-atmospheric pressure in the ink cartridge so that ink can be drawn in from the tank. When the coupling is disengaged, for example, in order to replace the ink cartridge and the nozzle head integrated therewith or in order to exchange the ink tank when it has become depleted, the valve mechanism of the coupling will automatically block the ink supply line so as to avoid leakage of ink from the ink tank and/or the supply line. Simultaneously, the valve mechanism will open the vent passage for venting the interior of the cartridge. Leakage of ink out of the cartridge, e.g. through the nozzles of the nozzle head, is normally prevented by capillary forces of a filling material. However, when the cartridge is closed air-tightly while it is not connected to the tank, a rise in temperature of the cartridge or a decrease in ambient atmospheric pressure creates a differential pressure which causes ink to be squeezed out of the cartridge. According to the present invention, this risk is avoided by automatically venting the cartridge when the coupling is disengaged.

Preferably, the ink supply line includes a flexible tube which connects the ink tank to the ink cartridge, and the ink tank is stationarily disposed at a level lower than that of the ink cartridge. As a result, a flow of ink from the tank into the cartridge will be caused only by sub-atmospheric pressure which is created inside of the cartridge when ink is consumed by the nozzle head. As a consequence, the level of liquid ink in the cartridge will automatically be held at a constant level.

The disengageable coupling is preferably disposed on the carriage. When the ink cartridge is detachably fitted to a support that is mounted on the carriage, the coupling comprises the cartridge-side connector part and a support-side connector part which are brought into engagement when the cartridge is fitted to the support. In a preferred embodiment, the support defines a pivotal axis for the cartridge, so that the cartridge may be fitted to the support by inserting it into the support in a tilted position and then pivoting the cartridge about said axis until the cartridge is snap-fastened at the support. In this case, the connector parts of the coupling are so arranged at the cartridge and at the support that their direction of mutual engagement is tangential to the pivotal axis. Thus, the coupling will automatically be engaged when the cartridge is snap-fastened in the operating position.

Preferably, the support-side connector part comprises a hollow mandrel which, when the coupling is engaged, penetrates an elastic seal member disposed in the cartridge-side connector part. Thus, when the coupling is disengaged and the mandrel is withdrawn from the seal member, the elastic seal member will contract and thereby close the passage from which the mandrel has been withdrawn. This will prevent dust and other contaminants from entering into the ink cartridge, while only the relatively small vent passage will be left open.

The vent passage or passages may be defined between the outer circumferential surface of the seal member and a rigid sleeve surrounding the same. Then, the vent passage may automatically be blocked and opened by the expansion and contraction, respectively, of the seal member.

The valve mechanism for blocking the ink supply line may be formed by a lateral outlet opening of the mandrel and an elastic sleeve which is slidably disposed on the mandrel so as to cover the outlet opening when the coupling is disengaged. The sleeve is preferably spring-biased into a closed position, and the cartridge-side connector part is arranged to push the sleeve back so as to open the outlet opening of the mandrel when the coupling is engaged and the mandrel penetrates into the cartridge-side connector part.

An end face of the slidable sleeve on the mandrel may at the same time serve as a valve member for closing the open end of the vent passage when the sleeve is pushed back by the cartridge-side connector part.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
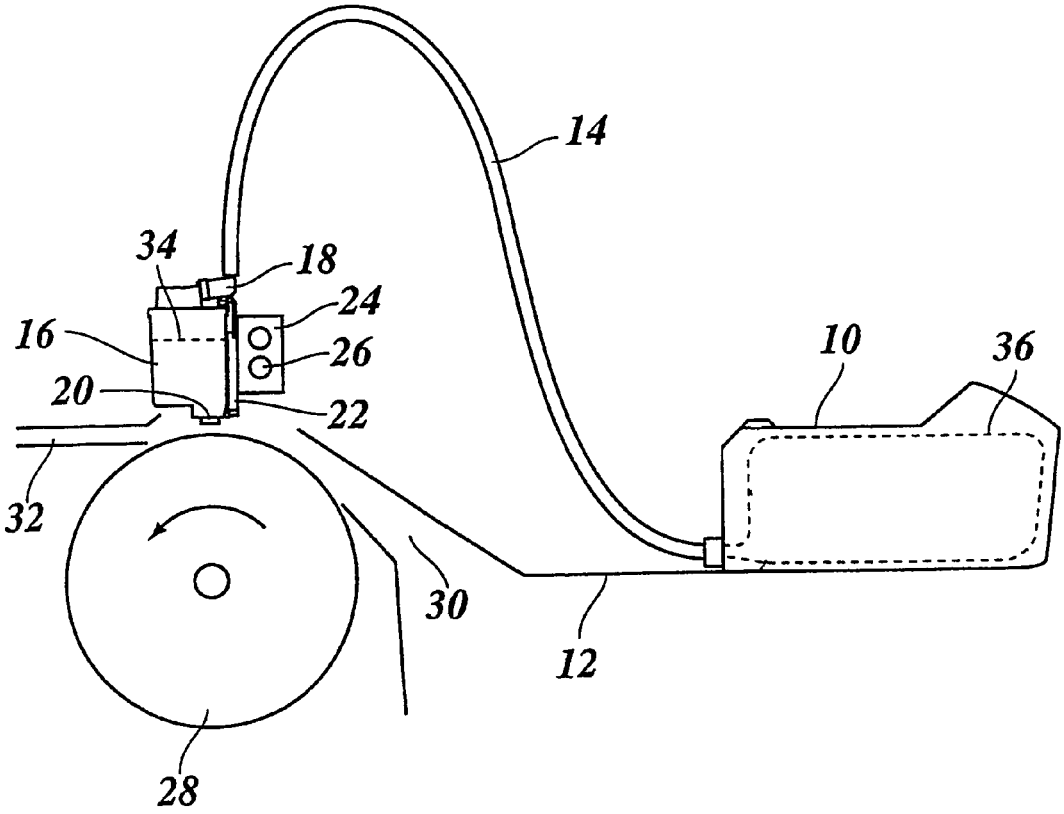
FIG. 1 is a schematic view showing the essential parts of an ink supply system of an ink jet printer.

As is shown in FIG. 1, an ink supply system for an ink jet printer includes an ink tank 10 mounted on a stationary frame 12 of the printer, a flexible tube 14 and an ink cartridge 16 connected to the tube 14 and hence the to tank 10 through a disengageable coupling 18. The cartridge 16 has an integrated nozzle head 20 and is detachably fitted to a support 22 which is held on a carriage 24. The carriage 24 is guided on guide rails 26 and is capable of traveling back and forth along a roller 28. When the printer is operating, a recording medium, e.g. a sheet of paper (not shown), is fed over the roller 28 via a feed path 30 and a discharge path 32, so that an image may be printed by the nozzle head 20.

The ink cartridge 16 is capable of accommodating only a relative small volume of liquid ink as compared to the volume of the ink tank 10. As can be seen in FIG. 1, the ink tank 10 is disposed below the level 34 of ink in the ink cartridge 16. The ink in the tank 10 is contained in a collapsible bag 36 which is connected to the tube 14. The outer casing of the tank 10 is vented. Capillary forces and the difference between the ink levels in tank 10 and cartridge 16 prevent the ink from leaking out of the ink cartridge 16 through the nozzles of the nozzle head 20.

In the condition shown in FIG. 1 in which the flexible tube 14 is connected to the ink cartridge 16 through the coupling 18, the space above the level 34 in the ink cartridge 16 is closed air-tightly. When the nozzle head 20 is operating and ink is consumed, the sub-atmospheric pressure changes in the ink cartridge 16, and ink is sucked-in from the tank 10 through the tube 14 and replaces the ink that has been consumed. In this way, the level 34 of ink in the cartridge 16 is held essentially constant.

Figure 2:
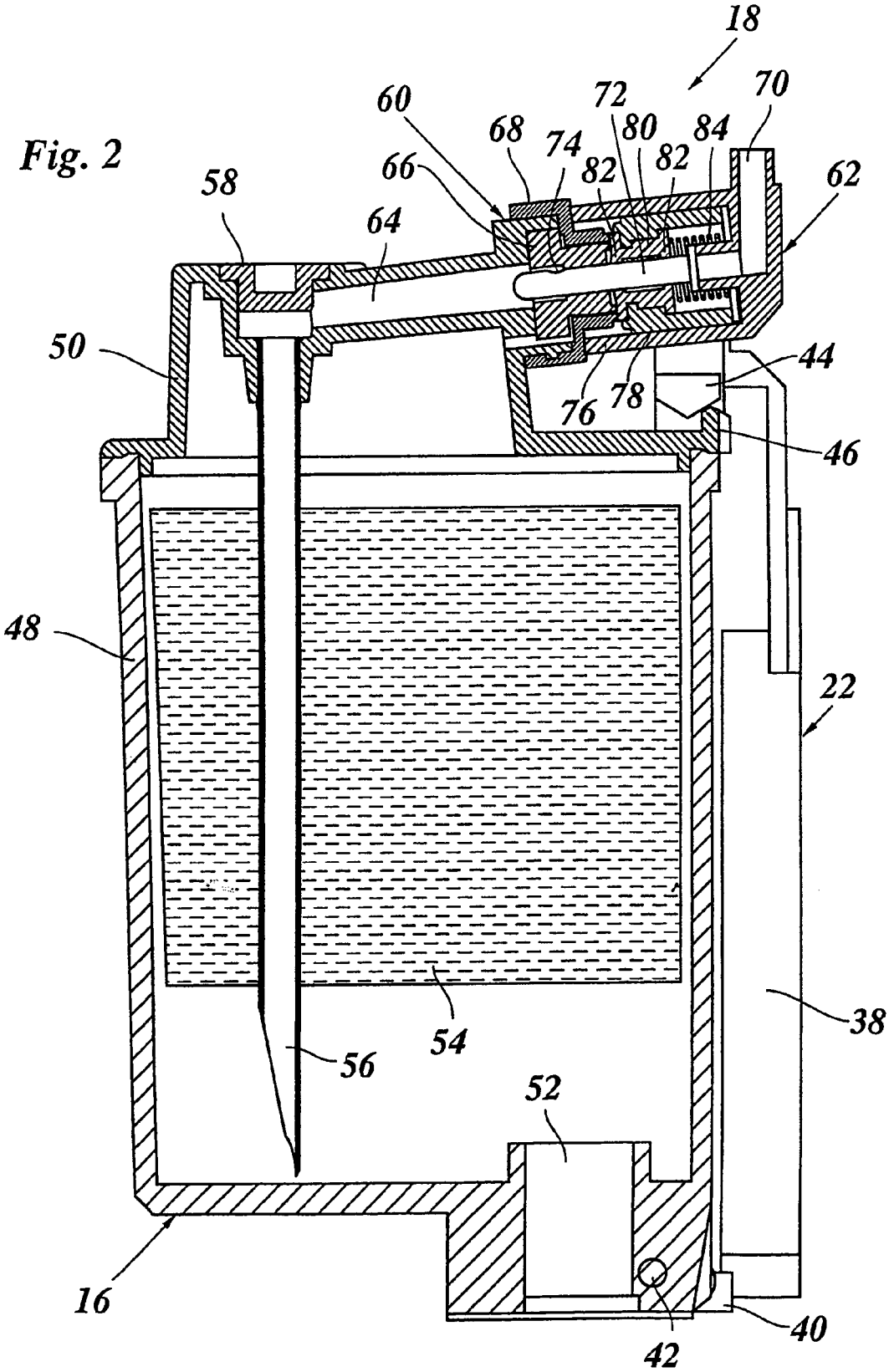
FIG. 2 is enlarged sectional view of an ink cartridge and a coupling forming part of the ink supply system.

As is shown in FIG. 2, the support 22 comprises an upright frame 38 and two lower horizontal arms 40 which embrace a lower edge of the ink cartridge 16. Although not shown in detail in the drawings, the lower arms 40 define a pivotal axis 42 about which the ink cartridge 16 may be pivoted. A downwardly biased locking member 44 is mounted at the top end of the frame 38 and cooperates with a catch 46 of the ink cartridge, so that the cartridge may be snap-fastened in an upright position in which it leans against the frame 38.

The ink cartridge 16 is formed by a vessel 48 which is made of plastic material and is sealingly closed by a cover 50. A bottom wall of the vessel 48 is formed with an outlet port 52 through which the ink is supplied to the nozzle head which has not been shown in FIG. 2. The vessel 48 accommodates a sponge withholding the ink in the vessel 48, so as to prevent the ink from leaking out of the nozzles of the nozzle head. The sponge 54 is pierced by a hollow needle 56 which is inserted through an opening formed in the cover 50. This opening is sealingly closed by a plug 58. The sponge 54 can fill the vessel 48 completely.

The coupling 18 comprises a cartridge-side connector part 60 which is integrated in the cover 50 of the ink cartridge, and a support-side connector part 62 which is fixedly mounted to the top end of the support 22. The connector part 60 communicates with the interior of the ink cartridge 16 through a passage 64 and through the needle 56. The end of the passage 64 facing the other connector part 62 accommodates an annular seal member 66 made of rubber-elastic material. The seal member 66 is surrounded and held in position by a rigid sleeve 68 fitted onto the open end of the connector part 60.

The support-side connector part 62 comprises an inlet port 70 connected to the flexible tube 14, and a hollow mandrel 72 which communicates with the inlet port 70 and, in the engaged condition shown in FIG. 2, penetrates the seal member 66 and projects into the passage 64 of the connector part 60. The hollow mandrel 72 is closed at its projecting end and communicates with the passage 64 through a lateral outlet opening 74 which opens into a recess of the seal member 66.

The connector part 62 defines a guide cylinder 76 which is arranged coaxially with the mandrel 72 and the passage 64 and extends tangentially relative to the pivotal axis 42. The guide cylinder 76 accommodates and guides a slidable piston 78 which is rigidly locked to an elastic sleeve 80. The sleeve 80 is slidable on the mandrel 72 and has two axially spaced seal portions 82 which tightly engage the outer circumferential surface of the mandrel 72. The sleeve 80 is biased against the end face of the rigid sleeve 68 by a spring 84.

Figure 3:
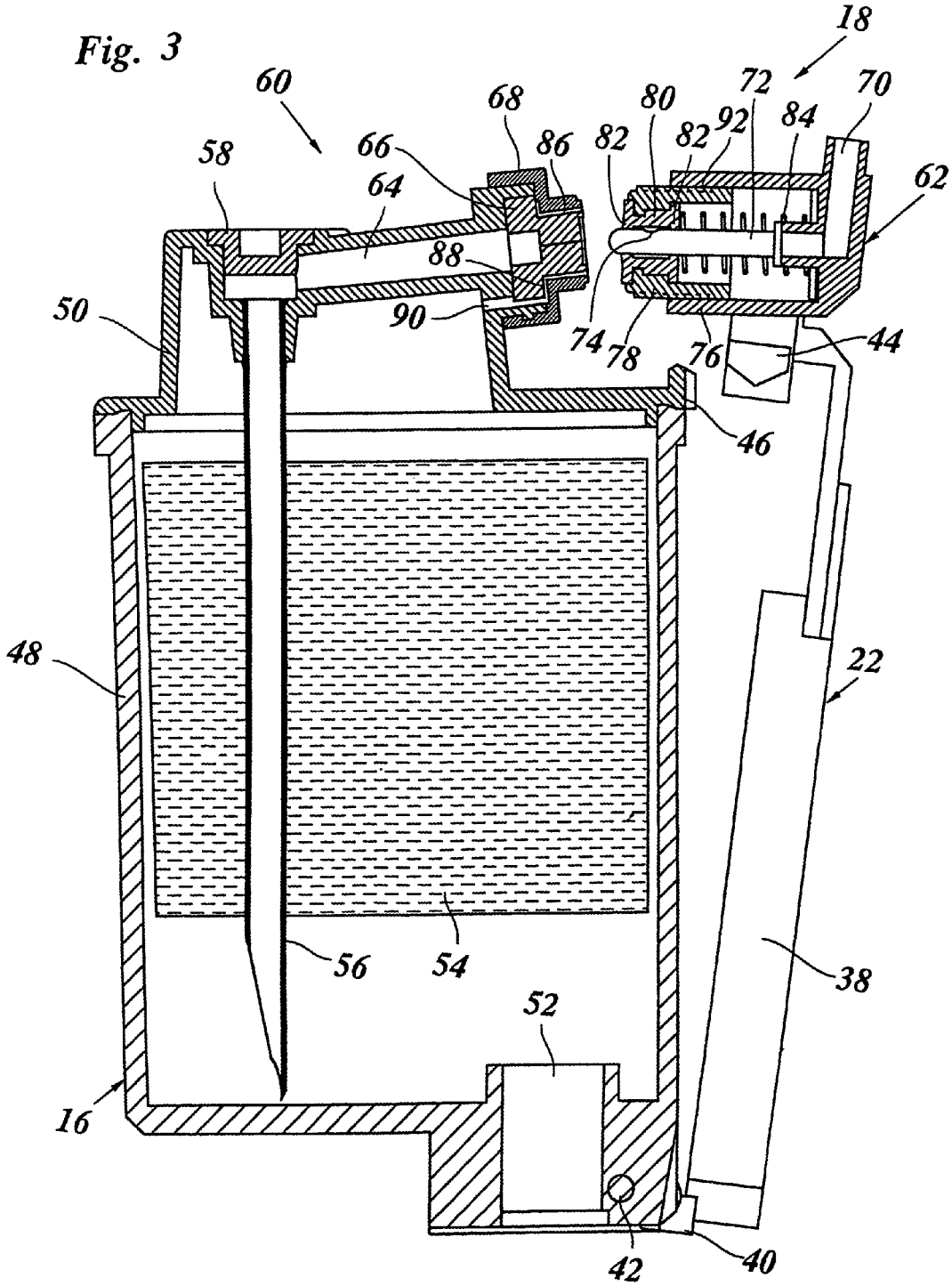
FIG. 3 shows the cartridge in a condition in which the coupling is disengaged.

In FIG. 3 the cartridge 16 has been tilted about the pivotal axis 42, so that the catch 46 has slid off from the locking member 44, and the mandrel 72 which is rigidly held in the connector part 62 has been retracted out of the elastic seal member 66 of the connector part 60. As a result, the elastic seal member 66 is contracted, and the internal cross-section thereof, which used to accommodate the mandrel 72, is reduced to zero, and, as a consequence, the passage 64 is closed.

Further, due to the contraction of the seal member 66, an annular gap 86 is formed between the outer circumferential surface of the seal member 66 and the inner circumferential surface of the rigid sleeve 68. The seal member 66 and the sleeve 68 each have a large diameter portion which serves for holding the seal member 66 in position. Since the connector parts 60 and 62 have been disengaged from one another, the annular gap 86 is open to the outside. The gap 86 communicates with the interior of the ink cartridge 16 through radial passages 88 and through axial passages 90 formed in the wall of the cover 50. Thus, the annular gap 86 and the passages 88, 90 form a vent passage for venting the interior of the ink cartridge 16, especially for venting the space above the sponge 54. As a result, the interior of the ink cartridge 16 is held at atmospheric pressure, so that, no ink will leak out of the nozzles of the nozzle head.

The labyrinth-like configuration of the passages 88, 90 prevents the entry of dust and dirt into the interior of the cover 50. In any event, such contaminants will be retained by the sponge 54 and thus will not contaminate the ink in and below the sponge.

As is further shown in FIG. 3, the spring 84 has pushed the piston 78 and the elastic sleeve 80 into an end position which is defined by mating keys 92 of the guide cylinder 76 and the piston 78. In this end position, the lateral outlet opening 74 of the mandrel 72 is located between the seal portions 82 of the elastic sleeve 80, so that the ink supply line formed by the flexible tube 14 and the connector part 62 is closed. This will prevent ink from leaking out of the tube 14 and, conversely, will prevent ambient air from entering into the tube 14 when the ink tends to flow back into the tank 10.

As can be seen in FIG. 3, the elastic sleeve 82 has an end face which faces the end of the connector part 60. When the ink cartridge 16 is tilted into the operative position shown in FIG. 2, the vent passage formed by the annular gap 86 will reliably be blocked-off by two redundant effects: 1.) When the mandrel 72 penetrates into the seal member 66, the annular seal member will expand and will be pressed against the internal surface of the rigid sleeve 68, so that the annular gap 86 is quenched. 2.) The end face of the elastic sleeve 80 engages the open end of the annular gap 86 and closes the same. This latter effect is further enhanced by providing concentric annular bosses at the end faces of the seal member 66 and the rigid sleeve 68.

The elasticity of the seal member 66 and of the elastic sleeve 80 further helps to compensate for a possible slight positional mismatch between the connector parts 60 and 62.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink supply system for an ink jet printer, comprising:

an ink cartridge adapted to accommodate a limited volume of liquid ink, an ink tank having a volume larger than said limited volume, and an ink supply line including a disengageable coupling, for providing communication between the ink tank and the ink cartridge, wherein said coupling includes a valve mechanism which, when the coupling is disengaged, automatically blocks the ink supply line and opens a vent passage for venting the interior of the ink cartridge said ink cartridge being adapted to be fitted to a support, and the coupling comprises a cartridge-side connector part and a support-side connector part which are engaged with one another when the ink cartridge is fitted to the support.

2. The ink supply system according to claim 1, wherein the ink cartridge is rotatably connected to said support and the cartridge-side connector part and support side connector part are arranged such that they can engage or disengage with one another based upon the relative rotation thereof.

3. The ink supply system according to claim 1, wherein the support side connector part of said coupling comprises a mandrel, and the cartridge side connector part of the coupling comprises an elastic seal member which is adapted to be received by said mandrel.

4. The ink supply system according to claim 3, wherein a portion of said vent passage is formed by an annular gap disposed between an outer circumferential surface of said seal member and a rigid sleeve surrounding the same, and said annular gap is so dimensioned that it is blocked-off when the seal member is received and expanded by the mandrel.

5. The ink supply system according to claim 3, wherein the support side connector part comprises an elastic sleeve which is slidable on the mandrel and is biased into a position in which it closes a lateral outlet opening of said mandrel, thereby blocking the ink supply line, and wherein the elastic sleeve is adapted to be pushed back to clear the outlet opening when the cartridge side connector part is engaged with the support side connector part.

6. Ink supply system according to claim 5, wherein the elastic sleeve on the mandrel is made of an elastomeric material and is rigidly locked to a piston which is slidably guided in the support side connector part.

7. Ink supply system according to claim 5, wherein the elastic sleeve on the mandrel has an end face adapted to engage the cartridge side connector part, and said cartridge side connector part is that in which the vent passage is arranged in such a position that it is blocked by the end face of said sleeve.

8. The ink supply system of claim 1, wherein the valve mechanism operation communicates with the vent passage during the engaging and disengaging of the coupling.

* * * * *